US006378214B1

(12) United States Patent
Onion

(10) Patent No.: US 6,378,214 B1
(45) Date of Patent: Apr. 30, 2002

(54) LOCKING KNIFE BLADE WITH MOVING LOCKING MECHANISM ON BLADE

(75) Inventor: Kenneth J. Onion, Kapolei, HI (US)

(73) Assignee: Kai U.S.A. Ltd., Wilsonville, OR (US)

( * ) Notice: Subject to any disclaimer, the term of this patent is extended or adjusted under 35 U.S.C. 154(b) by 0 days.

(21) Appl. No.: 09/591,183

(22) Filed: Jun. 8, 2000

Related U.S. Application Data

(63) Continuation-in-part of application No. 09/483,075, filed on Jan. 14, 2000.

(60) Provisional application No. 60/130,401, filed on Apr. 19, 1999, and provisional application No. 60/138,318, filed on Jun. 9, 1999.

(51) Int. Cl.[7] ..... B26B 1/04

(52) U.S. Cl. ..... 30/161; 30/160

(58) Field of Search ..... 30/155, 158, 159, 30/160, 161

(56) References Cited

U.S. PATENT DOCUMENTS

| | | | | |
|---|---|---|---|---|
| 226,910 | A | 4/1880 | Friebertshauser | |
| 551,052 | A | 12/1895 | Shonnard et al. | |
| 749,230 | A | 1/1904 | Severance | |
| 1,454,665 | A | 5/1923 | Bobek | |
| 1,743,022 | A | 1/1930 | Carman | |
| 4,040,081 | A | 8/1977 | Ninomiya et al. | |
| 4,347,665 | A | 9/1982 | Glesser | |
| 4,404,748 | A | 9/1983 | Wiethoff | |
| 4,451,982 | A | 6/1984 | Collins | |
| 4,502,221 | A | 3/1985 | Pittman | |
| 4,719,700 | A | 1/1988 | Taylor, Jr. | 30/158 |
| 4,805,303 | A | 2/1989 | Gibbs | 30/101 |
| 4,811,486 | A | 3/1989 | Cunningham | 30/161 |
| 4,837,932 | A | 6/1989 | Elsener | 30/161 |
| 4,896,424 | A | 1/1990 | Walker | 30/161 |
| 4,974,323 | A | 12/1990 | Cassady | 30/156 |
| 4,979,301 | A | 12/1990 | Walker | 30/161 |
| 5,044,079 | A | 9/1991 | Gibbs | 30/161 |
| 5,060,379 | A | 10/1991 | Neely | 30/161 |
| 5,095,624 | A | 3/1992 | Ennis | 30/161 |
| 5,111,581 | A | 5/1992 | Collins | 30/161 |
| 5,293,690 | A | 3/1994 | Cassady | 30/161 |

(List continued on next page.)

FOREIGN PATENT DOCUMENTS

| | | |
|---|---|---|
| DE | 1104386 | 4/1961 |
| FR | 1069862 | 7/1954 |
| FR | 1248117 | 10/1960 |

*Primary Examiner*—Hwei-Siu Payer
(74) *Attorney, Agent, or Firm*—Kolisch Hartwell Dickinson McCormack & Heuser

(57) ABSTRACT

A folding knife having a blade with a tang, and a handle with an end to which the tang is pivotally connected. The blade is rotatable relative to the handle about a pivot axis between an open position in which the blade is extended away from the handle and a closed position in which the blade is at least partially received within the handle. The folding knife may also include a post slidably held by the blade to slide along at least a portion of the blade between a retracted position and a locking position. When the blade is open and the post is in the locking position, the handle and post block pivoting of the blade from the open position toward the closed position. Additionally, the folding knife may be provided with an oversized tang portion and a spring mechanism that allow the knife blade to be easily pivoted into the open position.

26 Claims, 5 Drawing Sheets

U.S. PATENT DOCUMENTS

| | | | | | |
|---|---|---|---|---|---|
| 5,325,588 | A | * | 7/1994 | Rogers | 30/161 |
| 5,331,741 | A | | 7/1994 | Taylor, Jr. | 30/160 |
| 5,400,509 | A | | 3/1995 | Collins | 30/161 |
| 5,437,101 | A | | 8/1995 | Collins | 30/160 |
| D365,266 | S | | 12/1995 | Hasegawa | D8/99 |
| 5,502,895 | A | | 4/1996 | Lemaire | |
| 5,515,610 | A | | 5/1996 | Levin et al. | 30/161 |
| 5,537,750 | A | | 7/1996 | Seber et al. | 30/161 |
| 5,689,885 | A | | 11/1997 | Walston | 30/160 |
| 5,692,304 | A | | 12/1997 | Campbell | 30/161 |
| 5,737,841 | A | | 4/1998 | McHenry et al. | 30/161 |
| 5,755,035 | A | | 5/1998 | Weatherly | 30/161 |
| 5,802,722 | A | | 9/1998 | Maxey et al. | 30/160 |
| 5,815,927 | A | | 10/1998 | Collins | 30/161 |
| 5,822,866 | A | | 10/1998 | Pardue | 30/161 |
| 5,826,340 | A | | 10/1998 | Hull | 30/161 |
| 5,887,347 | A | | 3/1999 | Gibbs | 30/161 |
| 5,964,036 | A | | 10/1999 | Centofante | 30/161 |
| 6,079,106 | A | * | 6/2000 | Vallotton | 30/161 |
| 6,122,829 | A | * | 9/2000 | McHenry et al. | 30/161 |
| 6,145,202 | A | * | 11/2000 | Onion | 30/160 |
| 6,154,965 | A | * | 12/2000 | Sakai | 30/161 |

* cited by examiner

LOCKING KNIFE BLADE WITH MOVING LOCKING MECHANISM ON BLADE

CROSS REFERENCE TO RELATED APPLICATIONS

This application is a continuation-in-part of U.S. patent application Ser. No. 09/483,075, filed Jan. 14, 2000. This application also claims priority from U.S. Provisional Patent Application Ser. No. 60/130,401, filed Apr. 19, 1999 and U.S. Provisional Patent Application Ser. No. 60/138,318, filed Jun. 9, 1999.

BACKGROUND AND SUMMARY OF THE INVENTION

The present invention relates generally to a folding knife, and particularly to a folding knife having a locking mechanism that locks the blade in an open, deployed position and that may be used to both open and close the blade. This allows simple, one-handed unlocking and closing of the blade, with a single thumb-actuated motion. The same locking mechanism may be used for one-handed opening of the blade. In an alternative embodiment, the invention includes a spring mechanism and blade configuration that make opening the knife even easier.

Examples of folding knives may be found in the following U.S. patents: U.S. Pat. No. 1,454,665, issued May 8, 1923; U.S. Pat. No. 1,743,022, issued Jan. 7, 1930; U.S. Pat. No. 4,040,081, issued Aug. 9, 1977; U.S. Pat. No. 4,404,748, issued Sep. 20, 1983; U.S. Pat. No. 4,451,982, issued Jun. 5, 1984; U.S. Pat. No. 4,502,221, issued Mar. 5, 1985; U.S. Pat. No. 4,719,700, issued Jan. 19, 1988; U.S. Pat. No. 4,805,303, issued Feb. 21, 1989; U.S. Pat. No. 4,811,486, issued Mar. 14, 1989; U.S. Pat. No. 4,837,932, issued Jun. 13, 1989; U.S. Pat. No. 4,974,323, issued Dec. 4, 1990; U.S. Pat. No. 4,979,301, issued Dec. 25, 1990; U.S. Pat. No. 5,044,079, issued Sep. 3, 1991; U.S. Patent No. 5,060,379, issued Oct. 29, 1991; U.S. Pat. No. 5,095,624, issued Mar. 17, 1992; U.S. Pat. No. 5,111,581, issued May 12, 1992; U.S. Pat. No. 5,293,690, issued Mar. 15, 1994; U.S. Pat. No. 5,331,741, issued Jul. 26, 1994; U.S. Pat. No. 5,502,895, issued Apr. 2, 1996; U.S. Pat. No. 5,515,610, issued May 14, 1996; U.S. Pat. No. 5,537,750, issued Jul. 23, 1996; U.S. Pat. No. 5,689,885, issued Nov. 25, 1997; U.S. Pat. No. 5,692,304, issued Dec. 2, 1997; U.S. Patent No. 5,737,841, issued Apr. 14, 1998; U.S. Pat. No. 5,755,035, issued May 26, 1998; U.S. Pat. No. 5,802,722, issued Sep. 8, 1998; U.S. Pat. No. 5,822,866, issued Oct. 20, 1998; U.S. Pat. No. 5,826,340, issued Oct. 27, 1998; and U.S. Pat. No. 5,887,347, issued Mar. 30, 1999, the disclosures of which are incorporated herein by this reference thereto.

Common elements to folding knives include a handle and a blade pivotally connected to an end of the handle so that the blade pivots with respect to the handle between an open position in which the blade is extended away from the handle and a closed position in which the blade is at least partially received within the handle. In one embodiment of the present invention, a locking mechanism is formed from a post slidably mounted on the blade to engage the end of the handle to lock the blade in the open position. The post and blade are adapted to allow simple, one-handed unlocking and closing of the blade, with a single thumb-actuated motion. The post is also adapted to allow one-handed opening of the blade.

In other embodiments, which may or may not include the locking mechanism discussed above, an opening is defined through the handle so that an oversized tang portion of the blade may extend through the opening when the blade is in the closed position. An actuating spring may also be provided to operatively connect the blade and handle, such that the actuating spring urges the blade into the open position once the blade is rotated open beyond an equilibrium point. The actuating spring and oversized tang portion may be configured so that pushing the oversized tang portion into the handle causes the blade to pivot open beyond the equilibrium point so that the actuating spring causes the blade to pivot the rest of the way open.

DETAILED DESCRIPTION OF THE INVENTION

Figure 1:
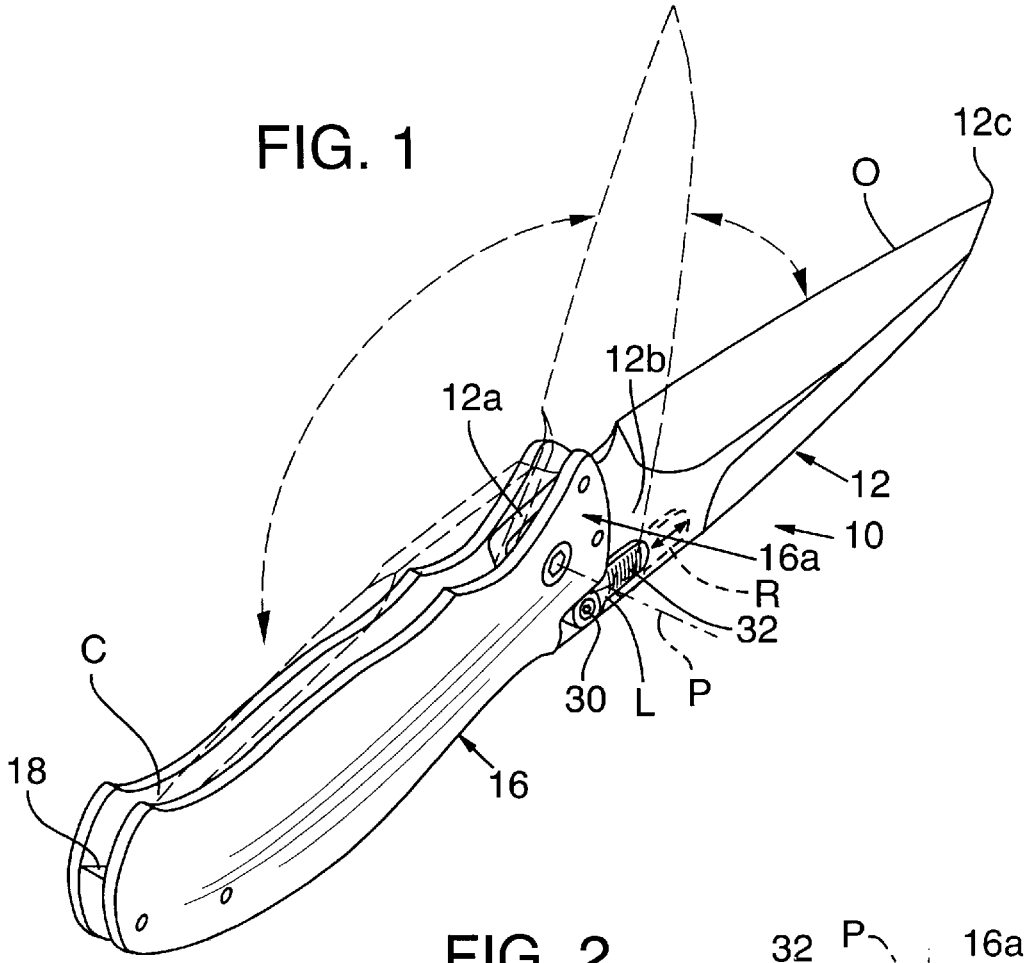
FIG. 1 is an isometric view of a folding knife according to the present invention.
Figure 2:
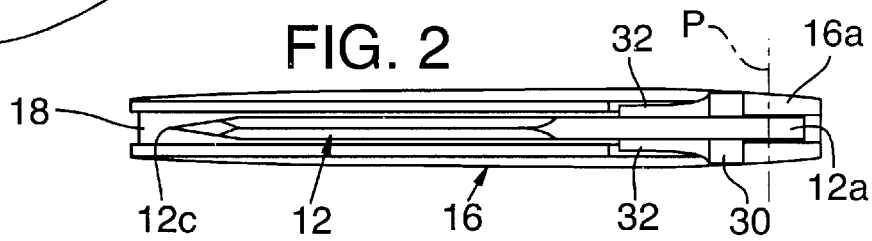
FIG. 2 is a front plan view of the knife of FIG. 1, showing the knife blade stored within a blade-receiving channel.

FIGS. 1 and 2 depict an embodiment of a folding knife 10 constructed according to the present invention. The depicted knife has an elongate blade 12 with a tang 12*a* pivotally connected to an end 16*a* of handle 16 so that the blade pivots with respect to the handle about a pivot axis P between an open position O and a closed position C. In the open position, the blade is extended away from the handle so that it is deployed and ready for use. From the open position, the blade can be folded toward the handle into the closed position, in which the blade is partially received for storage within a blade-receiving channel 18 defined in the handle.

The folding knife may be provided with a locking mechanism movably secured to the blade that locks the blade in the open, deployed position, and that may be used to both open and close the blade. When the blade is open, the locking mechanism may be moved into a locking position where the locking mechanism interacts with the knife handle to lock the blade in the open position. From this locked state, the locking mechanism can be retracted to unlock the blade so that it may be freely pivoted to the closed position. Further, the locking mechanism may be positioned on the blade so that a simple, one-handed motion may be used to open and lock the blade, and to unlock and close the blade.

As depicted in FIG. 1, the locking mechanism may be provided as a post 30, which extends transversely from flat surface 12*b* of blade 12. Post 30 is positioned near blade tang 12*a* but spaced from pivot axis P so that the post is exposed during the rotation of blade 12 between the closed and open positions. Post 30 is slidably held in a slot (shown in FIGS. 6 and 7) defined through blade 12 so that the post slides along the surface of the blade. Post 30 is slidable between a retracted position R at one end of the slot and a locking position L at the other end of slot, the locking position being spaced further from blade point 12*c* than the retracted position. As will be described in detail with reference to FIGS. 6 and 7, a spring may be provided in the slot to urge post 30 toward the locking position. Coverplates 32 are fixed to post 30 to conceal the slot and maintain the spring within the slot. Coverplates 32 may be formed integrally with post 30, as shown in FIG. 1, or formed separately and then secured to the post.

Post 30 and handle end 16*a* interact to lock the blade in the open position. Specifically, handle end 16*a* is adapted so that, when the blade is rotated into open position O, post 30 is allowed to slide into locking position L. When post 30 is in locking position L, handle end 16*a* blocks the post to prevent blade 12 from being pivoted toward closed position C, as shown in FIG. 1. In addition to the locking capability, post 30 can be used by an operator of the knife to easily open and close the blade, as will be later explained.

Figure 3:
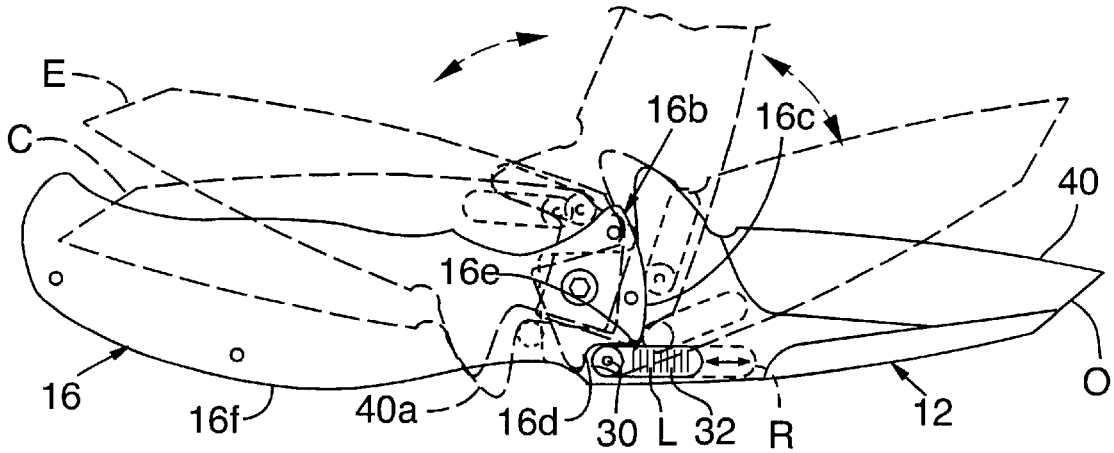
FIG. 3 is a side view of a folding knife according to the present invention, showing an alternate configuration for the knife blade.

FIG. 3 depicts a folding knife having the same locking mechanism, post 30, but with an alternately configured blade 40. FIG. 3 shows the interaction of post 30 with handle end 16*a* as the blade is pivoted with respect to the handle, including the locking of the blade in open position O. Handle end 16*a* may be formed to have an exposed exterior edge surface 16*b* including a rounded cam portion 16*c* and a locking portion 16*d*. Cam portion 16*c* and locking portion 16*d* are separated by corner 16*e*. Typically, and as depicted, locking portion 16*d* is formed as a notch cut into a back portion of the handle end 16*a*. A spring (not shown) may be provided to urge post 30 toward the locking position, and thus into engagement with handle end 16*a*. As blade 40 is rotated in a clockwise direction from the closed position toward the open position, post 30 thus first engages rounded cam portion 16*c*. With further rotation of blade 40, post 30 passes around corner 16*e* and into the notch to engage locking portion 16*d* of handle end 16*a*. While post 30 is maintained in locking position L, locking portion 16*d* of handle end 16*a* blocks the post and thus prevents blade 40 from being pivoted toward closed position C.

To unlock blade 40, post 30 is pushed toward retracted position R to disengage the post from locking portion 16*d* of handle end 16*a*. Once post 30 and locking portion 16*d* are thus disengaged, handle end 16*a* no longer blocks the post, and blade 40 may be pivoted toward the closed position. Although the depicted knife has a notch formed in the handle, handle end 16*a* can be formed in a variety of ways to interact with post 30 to selectively lock blade 40 in the open, deployed position.

As previously noted, FIG. 3 will also be seen to depict a blade having an alternate configuration from that shown in FIGS. 1 and 2. Specifically, blade 40 has an oversized tang portion 40*a* that is dimensioned to extend through the handle's blade receiving channel and out an opening in handle back 16*f* when the blade is closed. When thus exposed out the back opening, oversized tang portion 40*a* can be pushed back into the handle to pivot blade 40 toward the open position.

Figure 8:
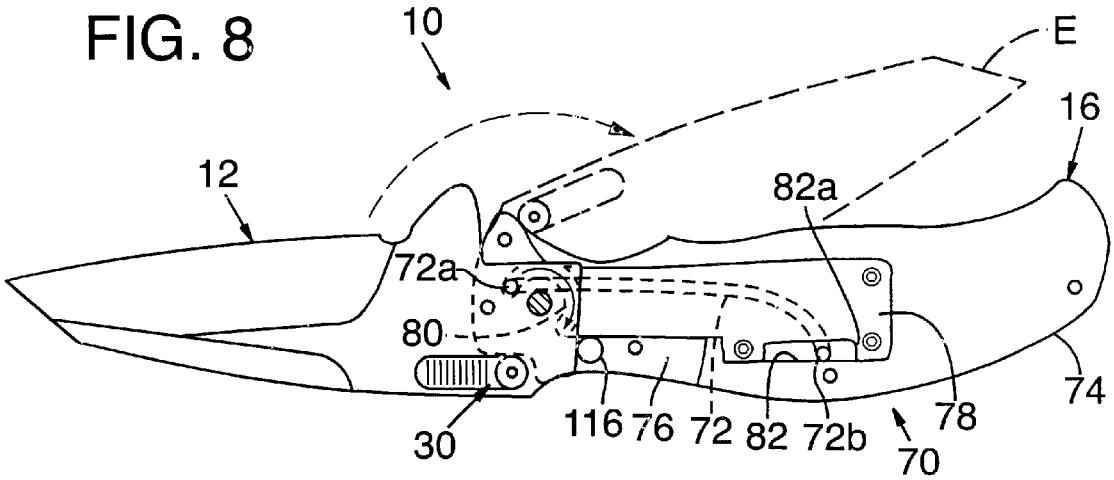
FIG. 8 is a side view of a knife blade and a grip and spring assembly according to the present invention, the assembly including an actuating spring for operatively interconnecting the blade and handle of the knife.

The folding knife of FIG. 3 may further be provided with an actuating spring, to be described in more detail with respect to FIG. 8, that operatively interconnects blade 40 and handle 16. Handle 16 and blade 40 cause the actuating spring to be compressed as they pivot relative to one another, such that the actuating spring exerts a closing or opening force on blade 40, depending on the relative position of the blade and handle. When blade 40 is at equilibrium position E, the actuating spring is maximally compressed, and when the blade is in either the open or closed positions, the spring is relatively uncompressed. Accordingly, when blade 40 is positioned rotationally to either side of equilibrium position E, the actuating spring causes the blade to pivot away from the equilibrium position. Thus, when blade 40 is between equilibrium position E and the closed position, the actuating spring urges the blade into the closed position. Similarly, when the blade is rotationally between the equilibrium position and the open position, the spring urges the blade toward the open position.

Oversized tang portion 40*a* and the actuating spring may be adapted so that the blade may quickly and easily be rotated into the open position. Specifically, and as shown in FIG. 3, oversized tang portion 40*a* may be sized so that fully pushing the oversized tang portion into the opening in handle back 16*f* causes blade 40 to pivot open beyond equilibrium position E. At that point, the actuating spring exerts an opening force to pivot blade 40 the rest of the way open. This allows the depicted knife to be opened in a variety of ways. For example, a person can use their thumb or fingers to push oversized tang portion 40*a* into the opening in handle back 16*f* and thus open blade 40. Alternatively, the knife can swiftly be brought into contact with a person's thigh or some other object to force oversized tang portion 40*a* into the opening.

Although a sliding post locking mechanism is depicted in FIG. 3, embodiments of the invented folding knife having an oversized tang portion may or may not be provided with this type of locking mechanism. Instead, the handle of the folding knife may be provided with a movable liner that can be positioned to abut the blade tang to thereby lock the blade in the open position. To unlock the blade, the liner is pushed in a sideways direction until it no longer blocks rotation of the blade. The liner may be biased so that it moves into the locking position to lock the blade whenever the blade is pivoted to the open position. Furthermore, any other suitable locking mechanism may be used, or the embodiment may not have a locking mechanism at all.

Figure 4:
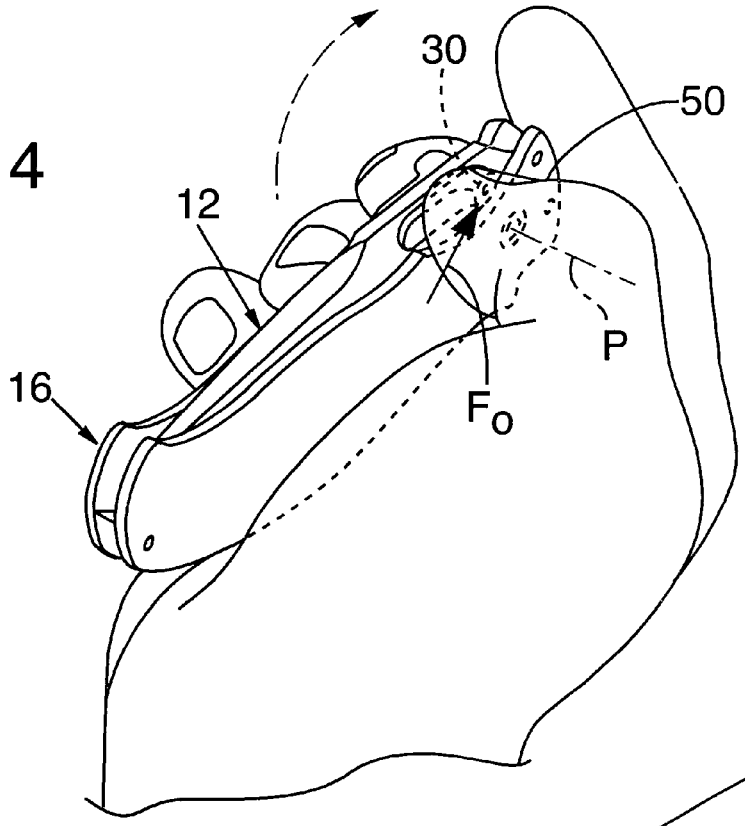
FIG. 4 is an isometric view showing a user's hand opening the blade of the knife of FIG. 1.

FIG. 4 depicts the folding knife of FIGS. 1 and 2 being opened by a user's hand. As will be appreciated from this and the preceding figures, post 30 is typically positioned on blade 12 so that it is exposed for manipulation by a user throughout the entire range of the blade's pivotal travel. Because post 30 extends transversely from the blade and is spaced from pivot axis P, an external force parallel to the plane of the blade may be exerted upon the post to cause the blade to pivot with respect to the handle.

As seen in FIG. 4, thumb 50 exerts opening force $F_o$ on post 30 to cause blade 12 to pivot toward the open position. As indicated, the position of the post allows the blade to be easily opened with one hand, with a simple thumb-actuated motion. In addition, the depicted knife may be provided with an actuating spring operatively connecting the handle and blade, as described with reference to FIG. 3, to further facilitate opening of the blade.

Figure 5:
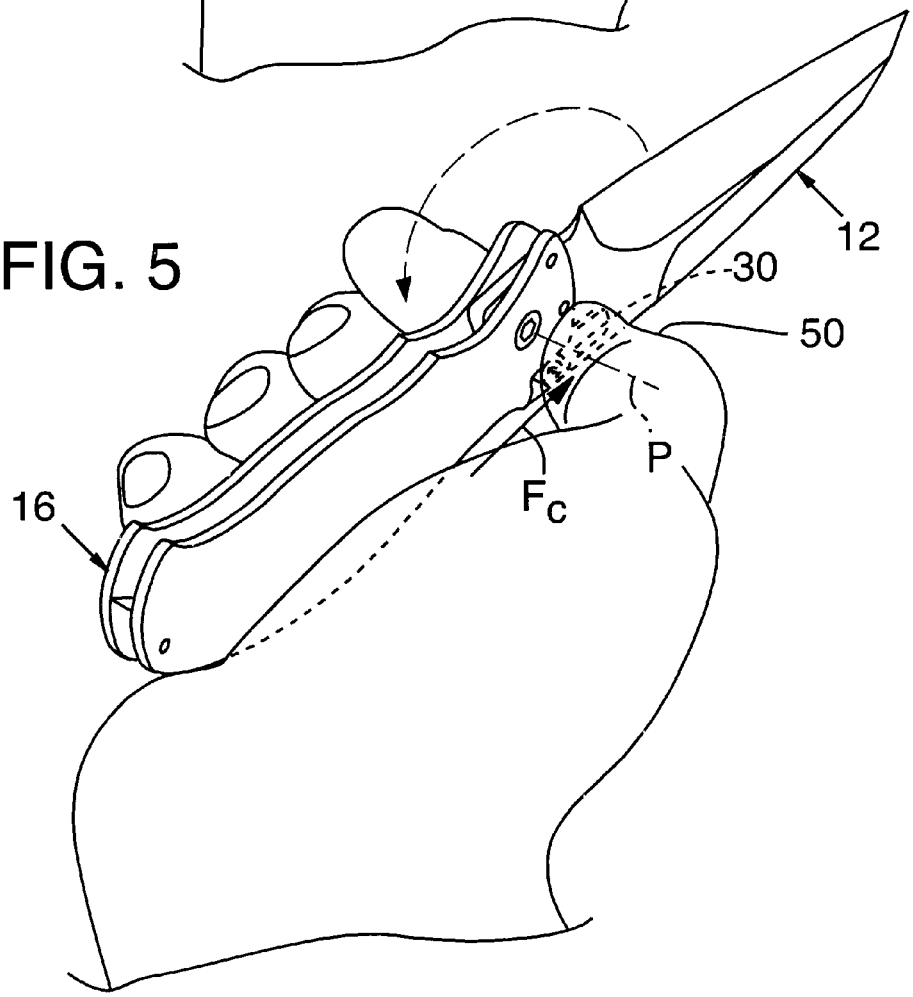
FIG. 5 is an isometric view showing a user's hand unlocking and closing the blade of the knife of FIG. 1.

As shown in FIG. 5, a similar motion may be used to unlock blade 12 and rotate the blade from the open position into the closed position. Thumb 50 is shown to exert a closing/unlocking force $F_c$ upon post 30 to disengage the post from the locking portion 16*d* of handle end 16*a* and rotate the blade toward the closed position.

Figure 6:
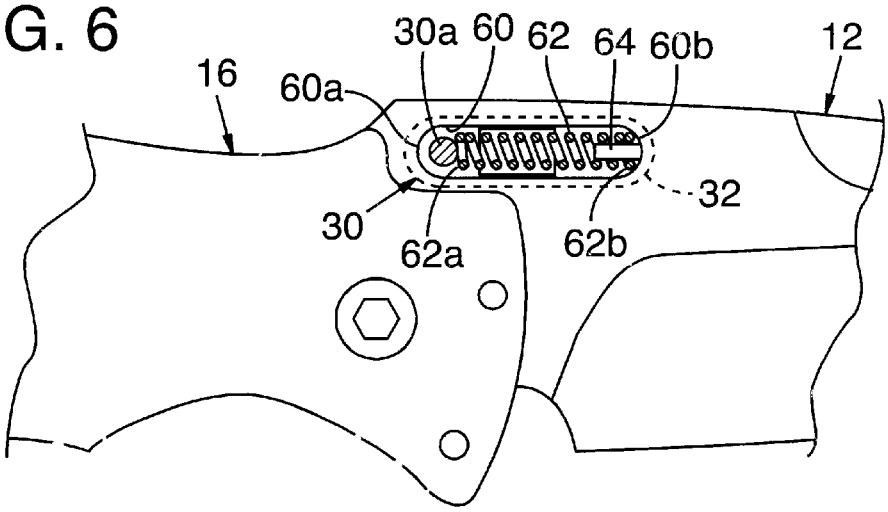
FIG. 6 is an expanded, fragmentary side view showing the connection between the locking mechanism and blade of the knife of FIG. 1.
Figure 7:
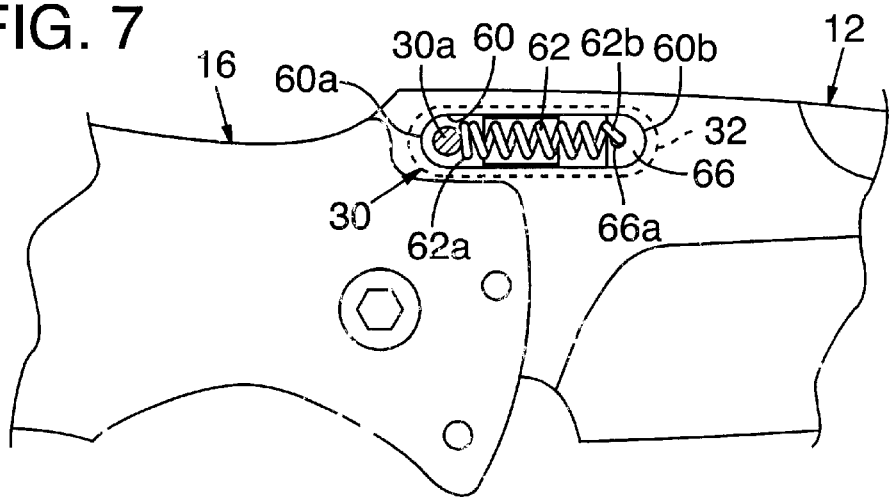
FIG. 7 is an expanded, fragmentary side view similar to FIG. 6, but showing an alternate means of connecting the locking mechanism and blade.

FIGS. 6 and 7 are enlarged fragmentary views of the knife of FIGS. 1 and 2 that depict a slot 60 formed through blade 12 for slidably holding locking post 30. A central portion 30*a* of post 30 is transversely positioned within slot 60, which is elongate and larger in width than the diameter of central portion 30*a* of post 30. Spring 62 is positioned in slot 60 and secured between blade 12 and central portion 30*a* of post 30 to urge the post along the slot toward slot end 60*a* into the locking position. A first end 62*a* of spring 62 is attached to the post's central portion 30*a,* with a second end 62*b* being attached to blade 12 near slot end 60*b.*

As shown in FIG. 6, slot 60 may be provided with a spring attachment member 64 that extends into slot end 60*b,* with spring end 62*b* being wrapped around attachment member 64. Though depicted as a small, cylindrical post, attachment member 64 can be of any size and shape suitable for attachment with spring 62. Alternatively, as shown in FIG. 7, a recessed area 66 may be provided at slot end 60*b,* with a hole 66*a* being defined through the recessed area so that spring end 62*b* can be threaded through the hole to secure the spring to the blade.

FIG. 8 depicts a grip and spring assembly 70 constructed according to the present invention, with a blade 12 pivotally attached to the grip and spring assembly. A fully assembled folding knife would include an additional grip piece fastened to grip and spring assembly 70 to pivotally secure the blade between the grip and spring assembly and the additional grip piece. The depicted knife is partially assembled to clearly show the operation of actuating spring 72.

Grip and spring assembly 70 includes a grip piece 74, a reinforcement member 76 secured to an end of the grip piece, a coverplate 78 fastened to an interior side of the grip piece, and an actuating spring 72. The way in which grip piece 74, reinforcement member 76, and coverplate 78 are configured will be more clearly depicted and explained with reference to FIG. 9. Actuating spring 72 is contained within a cavity formed between coverplate 78 and grip piece 74. A first end 72*a* of actuating spring 72 extends out of the cavity through an arcuate notch 80 formed by the edges of reinforcement member 76 and coverplate 78, and is attached to blade 12. Spring end 72*a* is attached to blade 12 at a location spaced from the blade's pivot point, such that the spring travels along an arcuate path as the blade is rotated. Arcuate notch 80 is adapted to accommodate the travel of spring end 72*a.* A second end 72*b* of the actuating spring is movably held within a slot 82 formed by the coverplate and handle piece.

Spring 72 is subjected to varying degrees of compression as blade 12 is pivoted. When blade 12 is in the open position, the spring is in an uncompressed state. As blade 12 is rotated toward the closed position, spring end 72*a* follows the indicated arcuate path and spring end 72*b* is forced into contact with slot end 82*a,* causing spring 72 to be compressed. Spring 72 is maximally compressed when spring end 72*a* is at the point of its arcuate travel where it is closest to slot end 82*a.* As previously discussed, this occurs when blade 12 is in equilibrium position E, shown here in dashed lines. When blade 12 is positioned to either side of equilibrium point E, spring 72 forces the blade toward the open or closed position, in which the spring is in a relatively uncompressed state.

Figure 9:
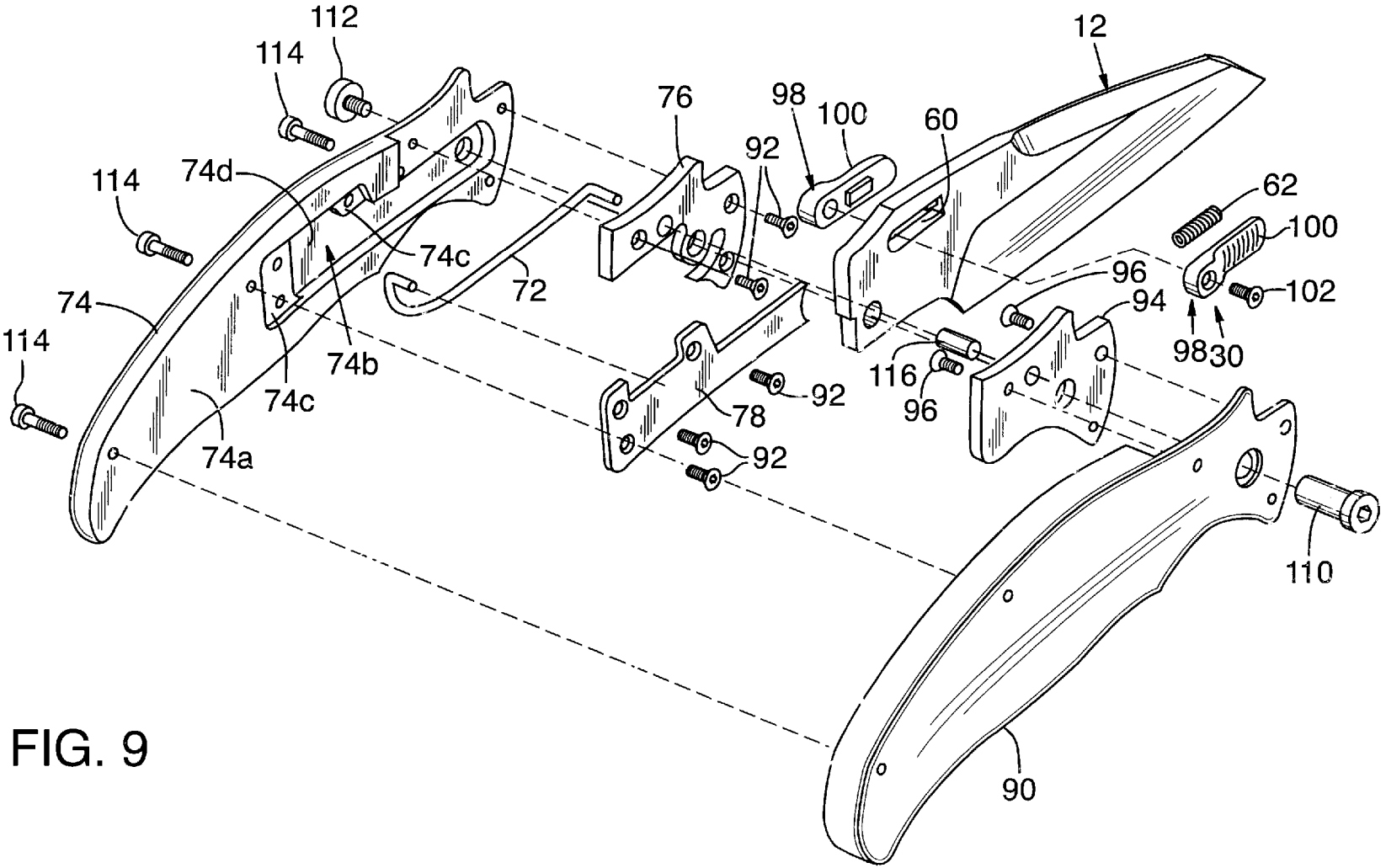
FIG. 9 is an exploded isometric view of the knife of FIG. 1.

FIG. 9 is an exploded isometric view of the folding knife depicted in FIGS. 1 and 2 showing how handle grip pieces 74 and 90, blade 12, post 30, and actuating spring 72 are assembled with the various other parts of the knife. As indicated, coverplate 78 and reinforcement member 76 are fastened to grip piece 74 with screws 92, so that spring 72 is secured within a cavity formed by coverplate 78 and grip piece 74. Interior surface 74*a* of grip piece 74 is formed to have a two-depth recess 74*b* including shelf portions 74*c* and a deeper central portion 74*d.* Coverplate 78 is fastened to shelf portions 74*c* so that the coverplate can be fastened flush to interior surface 74*a* of grip piece 74 while still providing a cavity in which spring 72 is able to move.

Grip piece 74, spring 72, coverplate 78, and reinforcement member 76 comprise a grip and spring assembly that may be assembled separately from the other depicted components. In some settings, stage assembly is simpler and less expensive than known methods of manufacture, which often require that all parts of the knife be simultaneously aligned and fastened together.

The depicted knife includes a second reinforcement member 94 fastened to grip piece 90 with screws 96. Reinforcement members 76 and 94 strengthen the end of handle 16 and partly form the exterior edge surface engaged by post 30 as the blade pivots between the open and closed positions. As indicated, locking post 30 may be formed of two complementary lock post pieces 98 having integrally formed spring-retaining coverplates 100. The lock post pieces are secured together by a fastener 102 that extends through slot 60 formed through blade 12. The lock post pieces are slidable along the length of slot 60 and, as previously described, a spring 62 is provided to bias post 30 along the slot so that the post engages the end of the knife handle.

The blade is pivotally secured between grip pieces 74 and 90 and reinforcement members 76 and 94 with an internally threaded pivot post 110 that extends through holes in the grip pieces, reinforcement members and blade to receive a fastener 112. The grip pieces are secured together with fasteners 114. Finally, a stop post 116 is secured between reinforcement members 76 and 94 to abut the blade tang when the blade is in the open position and provide a terminal point beyond which the blade cannot be opened.

Figure 10:
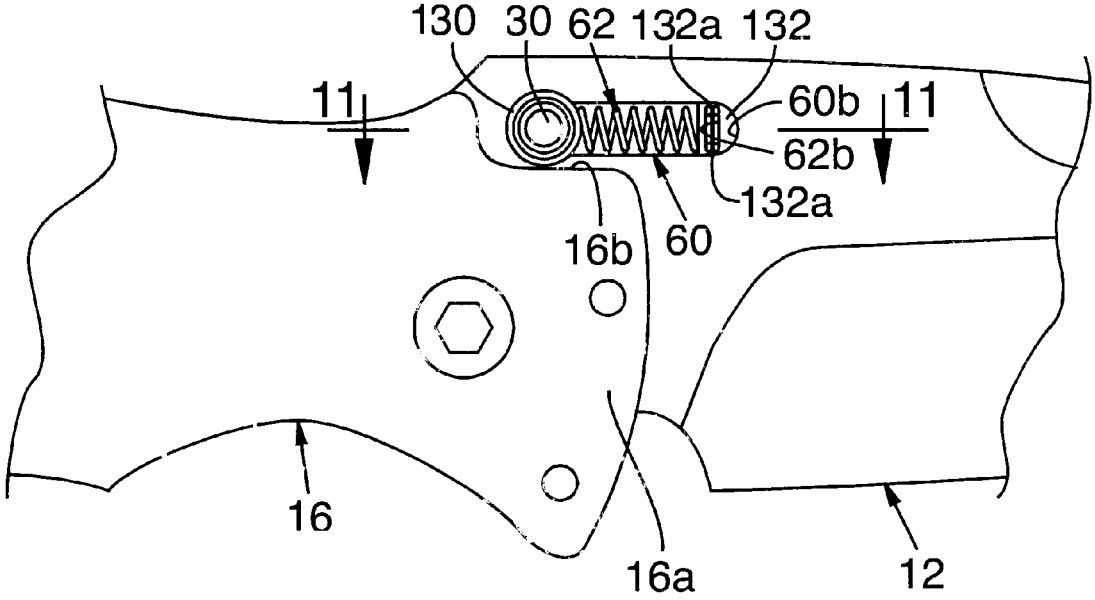
FIG. 10 is an expanded, fragmentary side view of a folding knife constructed according to the present invention and having an alternately configured locking mechanism and blade.
Figure 11:
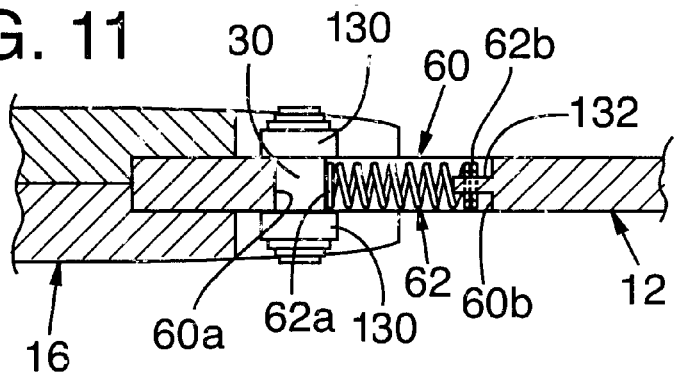
FIG. 11 is a partially sectioned top view of the folding knife taken along line 11—11 shown in FIG. 10.

FIGS. 10 and 11 show another embodiment of a folding knife constructed according to the present invention, in which locking post 30 is provided with one or more collars 130 that act as roller bearings. Collars 130 roll as they bear against the bolster portion (exterior edge 16*b*) of handle end 16*a,* thereby preventing any scratching or wearing of the bolster, and improving the smoothness of the locking mechanism. Collars 130 may be pressed, swaged, welded, or machined in place on post 30 so that the post and collars roll together, or they may be rotatably mounted on the post so that the collars roll around the post. Yet another alternative is to integrally form the collars with the post.

Preferably, each collar 130 collectively defines with post 30 a stacked-disk shape, as seen best in FIG. 11. This shape has been found to be easy to engage by the thumb of a hand, without the thumb rolling off the bearing. Pressing collars 130 in place on post 30 allows the friction between spring 62 and the post to limit the amount by which the collars roll relative to a thumb opening or closing the knife, without limiting the rolling of the collars relative to the bolster of the handle during opening or closing of the blade.

FIGS. 10 and 11 also show an alternative embodiment of blade 12, in which the blade is formed with spring-retaining holes 132*a* at end 60*b* of elongate slot 60, preferably within a recess 132 formed at end 60*b* so that spring 62 may be held completely within the blade. One or more coils of spring 62 are threaded through holes 132*a* to retain end 62*b* of the spring in elongate slot 60. Opposing end 62*a* may be trapped within inner faces of collar bearings 130, or within an enlarged head provided on post 30, or simply may bear against the post. Furthermore, the blade of FIGS. 10 and 11 may be used with coverplates 32 shown in FIGS. 1–3.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various features, elements, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or presentation of new claims in this or a related application. Such claims, whether they are different, broader, narrower or equal in scope to the original claims, are also regarded as included within the subject matter of the invention.

I claim:

1. A folding knife, comprising:

a blade including a tang, a slot within the blade, and a pair of holes;

a handle having an end to which the tang is pivotally connected, the end having an exposed exterior edge surface, the blade being rotatable about a pivot axis between an open position in which the blade is extended away from the handle and a closed position in which the blade is at least partially received within the handle;

a post slidably held by the blade and adapted to slide along the slot such that as the blade is rotated between the open and closed positions, the post is allowed to slide toward the end of the handle to engage the exposed exterior edge surface, and wherein the post can, after the blade is rotated to the open position, be retractably slid toward the end of the handle into a locking position in which the post interacts with the exposed exterior edge surface to lock the blade in the open position; and a spring having first and second ends, the spring being disposed within the slot and operatively connecting the blade and the post to urge the post toward the locking position, wherein the second end of the spring is threaded through the pair of holes.

2. The folding knife of claim 1, wherein the handle further comprises a reinforcement member located at the end of the handle to form at least part of the exposed exterior edge surface, the reinforcement member being adapted to reinforce the handle as it is engaged by the post when the post is in the locking position.

3. The folding knife of claim 1, wherein the exposed exterior edge surface has a locking portion including a corner, wherein as the blade is rotated from the closed position to the open position, the post passes around the corner and is allowed to slide toward the locking position to engage the locking portion and lock the blade in the open position.

4. The folding knife of claim 1, further comprising a notch defined on the end of the handle, wherein the post may slide into the notch toward the locking position when the blade is in the open position so that the post and the end of the handle block pivoting of the blade from the open position toward the closed position.

5. The folding knife of claim 1, further comprising a spring operatively connected between the tang of the blade and the handle, wherein the spring is compressed to exert a pivoting force upon the blade as the blade is rotated between the open and closed positions.

6. The folding knife of claim 1, further comprising:

an opening in the handle extending from a blade-receiving channel in the handle through a back of the handle; and an oversized tang portion of the blade that is sized to extend through the opening in the handle when the blade is stored in the handle so that the oversized tang portion is exposed for manipulation from the back of the handle.

7. The folding knife of claim 6, further comprising a spring operatively connected between the tang of the blade and the handle, wherein the spring is compressed to exert a pivoting force upon the blade as the blade is rotated between the open and closed positions.

8. The folding knife of claim 7, wherein the spring is adapted to force the blade to pivot toward the open position when the oversized tang portion of the blade is pushed into the handle until the spring reaches an equilibrium point.

9. The folding knife of claim 1, wherein the post is provided with a bearing portion configured to engage and roll against the exposed exterior edge surface of the end of the handle as the blade is pivoted relative to the handle.

10. The folding knife of claim 9, wherein the bearing portion is exposed for manipulation by a user's thumb.

11. The folding knife of claim 9, wherein the bearing portion is formed in a stacked disk configuration.

12. A folding knife, comprising:

a blade including a tang, a slot within the blade, and a pair of holes;

a handle having an end to which the tang is pivotally connected, the blade being rotatable about a pivot axis between an open position in which the blade is extended away from the handle and a closed position in which the blade is at least partially received within the handle;

a post extending transversely outward from the blade and slidably held by the blade to slide along the slot within the blade between a retracted position and a locking position; and a spring having first and second ends, the spring being disposed within the slot and operatively connecting the blade and the post to urge the post toward the locking position, wherein the second end of the spring is threaded through the pair of holes.

13. The folding knife of claim 11, wherein the slot passes through the blade.

14. The folding knife of claim 13, wherein the post is transversely disposed within the slot.

15. The folding knife of claim 14, wherein the blade further comprises a recessed area located near an end of the slot and the pair of holes extend through the recessed area.

16. The folding knife of claim 15, wherein the first end of the spring is attached to the post.

17. The folding knife of claim 12, wherein the first end of the spring is attached to the post.

18. The folding knife of claim 12, further comprising a plate secured to the post and adapted to at least partially cover the slot.

19. The folding knife of claim 12, wherein the post is slidably held by the blade at a location spaced from the pivot axis so that the post is exposed as the blade rotates between the open and closed positions, whereby an external force may be applied to the post at any point in the blade's pivotal travel between the open and closed positions to cause the blade to pivot with respect to the handle.

20. The folding knife of claim 12, wherein the blade includes a point opposite the tang, and wherein the post is closer to the point when in the retracted position than when in the locking position.

21. The folding knife of claim 12, further comprising a spring operatively connected between the tang of the blade and the handle, wherein the spring is compressed to exert a pivoting force upon the blade as the blade is rotated between the open and closed positions.

22. The folding knife of claim 21, wherein the spring is adapted to be maximally compressed at an intermediate point between the open and closed positions, such that the spring urges the blade into the open position when the blade is rotationally between the intermediate point and the open position and into the closed position when the blade is rotationally between the intermediate point and the closed position.

23. The folding knife of claim 12, further comprising:

an opening in the handle extending from a blade-receiving channel in the handle through a back of the handle; and an oversized tang portion of the blade that is sized to extend through the opening in the handle when the blade is stored in the handle so that the oversized tang portion is exposed through the back of the handle.

24. The folding knife of claim 23, further comprising a spring operatively connected between the tang of the blade and the handle, wherein the spring is compressed to exert a pivoting force upon the blade as the blade is rotated between the open and closed positions.

25. The folding knife of claim 24, wherein the spring is adapted to force the blade to pivot toward the open position when the oversized tang portion of the blade is pushed into the handle until the spring reaches an equilibrium point.

26. A folding knife, comprising:

a blade including a tang, a slot within the blade, and a pair of holes;

a handle having an end to which the tang is pivotally connected, the blade being rotatable about a pivot axis between an open position in which the blade is extended away from the handle and a closed position in which the blade is at least partially received within the handle;

a notch defined on the end of the handle;

a post extending transversely outward from the blade and slidably held by the blade to slide along at least a portion of the blade between a retracted position and a locking position, wherein the post and the notch are adapted such that when the blade is rotated into the open position, the post can be retractably slid into the locking position to interact with the handle and lock the blade in the open position; and a spring having first and second ends, the spring being disposed within the slot and operatively connecting the blade and the post to urge the post toward the locking position, wherein the second end of the spring is threaded through the pair of holes.

* * * * *